US010113454B2

(12) United States Patent
Yanagawa et al.

(10) Patent No.: US 10,113,454 B2
(45) Date of Patent: Oct. 30, 2018

(54) CONTROL DEVICE OF ENGINE

(71) Applicant: MITSUBISHI JIDOSHA KOGYO KABUSHIKI KAISHA, Tokyo (JP)

(72) Inventors: Kensuke Yanagawa, Tokyo (JP); Takashi Kawabe, Tokyo (JP); Koji Hata, Tokyo (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 190 days.

(21) Appl. No.: 15/337,363

(22) Filed: Oct. 28, 2016

(65) Prior Publication Data

US 2017/0122149 A1 May 4, 2017

(30) Foreign Application Priority Data

Oct. 30, 2015 (JP) ..... 2015-214119

(51) Int. Cl.
*F01M 3/04* (2006.01)
*F01M 1/16* (2006.01)
(Continued)

(52) U.S. Cl.
CPC ..... *F01M 1/16* (2013.01); *F01M 1/08* (2013.01); *F02D 35/028* (2013.01); *F01M 2250/60* (2013.01); *F01M 2250/62* (2013.01)

(58) Field of Classification Search
CPC . F01M 1/08; F02D 35/027; F02D 2041/1412; F02B 77/085
(Continued)

(56) References Cited

U.S. PATENT DOCUMENTS 5,905,193 A * 5/1999 Hashizume ..... G01L 23/221 701/111
2011/0144882 A1* 6/2011 Bidner ..... F01M 1/08 701/102
(Continued)

FOREIGN PATENT DOCUMENTS

JP 62-131961 A 6/1987
JP 2005-214214 A 8/2005
(Continued)

OTHER PUBLICATIONS

Extended European Search Report dated Apr. 6, 2017 issued in corresponding EP Application No. 16196381.4.

*Primary Examiner* — Marguerite McMahon
*Assistant Examiner* — James Kim
(74) *Attorney, Agent, or Firm* — Birch, Stewart, Kolasch & Birch, LLP

(57) ABSTRACT

A control device of an engine, the engine including: a piston contained in a cylinder; an intake passage communicated to a combustion chamber of the cylinder; an exhaust passage led from the combustion chamber; a fuel injection valve configured to inject fuel to the combustion chamber or the intake passage; and an ignition unit provided in the combustion chamber, includes: a low speed pre-ignition predicting unit configured to perform prediction of occurrence of low speed pre-ignition, based on operation condition of the engine; and a lubricating oil injection controlling unit configured to control a lubricating oil injecting device to inject lubricating oil to the piston or a member located around the piston, based on the prediction of the occurrence of the low speed pre-ignition performed by the low speed pre-ignition predicting unit.

9 Claims, 3 Drawing Sheets

(51) Int. Cl.
*F01M 1/08* (2006.01)
*F02D 35/02* (2006.01)

(58) Field of Classification Search
USPC ..... 123/196 M, 41.1, 41.31, 41.35, 305; 701/102
See application file for complete search history.

(56) References Cited

U.S. PATENT DOCUMENTS

| | | | | |
|---|---|---|---|---|
| 2012/0277983 | A1* | 11/2012 | Makino | F02D 35/027 701/113 |
| 2013/1079049 | | 7/2013 | Grieser et al. | |
| 2016/0245210 | A1* | 8/2016 | Sasaki | F02D 41/222 |
| 2017/0058807 | A1 | 3/2017 | Yanagawa et al. | |

FOREIGN PATENT DOCUMENTS

| | | | |
|---|---|---|---|
| JP | 2006-138307 | A | 6/2006 |
| JP | 2010-84619 | A | 4/2010 |

* cited by examiner

FIG. 3A

WALL FACE ADHERED FUEL CORRECTION COEFFICIENT (EXAMPLE 1)

| WATER TEMPERATURE \ INJECTION TIME | 300 | 270 | 240 | 210 | 180 |
|---|---|---|---|---|---|
| 90 | a | a | b | c | e |
| 80 | b | b | c | d | f |
| 70 | c | c | e | e | g |
| 60 | e | e | f | g | i |
| 50 | g | g | h | i | j |
| 40 | i | i | j | k | l |
| 30 | k | k | l | m | n |

FIG. 3B

WALL FACE ADHERED FUEL CORRECTION COEFFICIENT (EXAMPLE 2)

| AMOUNT OF WALL FACE ADHERED FUEL (mg) | 5 | 10 | 15 | 20 | 25 | 30 |
|---|---|---|---|---|---|---|
| CORRECTION COEFFICIENT | a | c | e | g | i | k |

FIG. 3C

INTAKE OXYGEN CONCENTRATION CORRECTION COEFFICIENT

| RECIRCULATED GAS RATE (%) | 2.0 | 4.0 | 6.0 | 8.0 | 10.0 | 12.0 |
|---|---|---|---|---|---|---|
| CORRECTION COEFFICIENT | a | v | w | x | y | z |

CONTROL DEVICE OF ENGINE

CROSS-REFERENCE TO RELATED APPLICATION(S)

This application is based upon and claims the benefit of priority from prior Japanese patent application No. 2015-214119, filed on Oct. 30, 2015, the entire contents of which are incorporated herein by reference.

BACKGROUND

The present invention relates to a control device of an engine which is provided with an exhaust gas recirculation device, and more particularly, to the control device of the engine for preventing occurrence of low speed pre-ignition which occurs, while the engine is operated at low speed rotation and a high load.

In many cases, an engine which is mounted on a vehicle or the like is provided with an exhaust gas recirculation device. The exhaust gas recirculation device recirculates a part of an exhaust gas which is exhausted from a combustion chamber of the engine to the atmosphere through an exhaust passage, into an intake passage, thereby to lower combustion temperature inside the combustion chamber, and to restrain exhaustion of nitrogen oxide (NOx) which is contained in the exhaust gas.

Moreover, there has been a technique for reducing abnormal combustion inside the combustion chamber of the engine, using the exhaust gas which is recirculated to the intake passage (hereinafter referred to as "recirculated gas") by the exhaust gas recirculation device.

For example, in JP-A-S62-131961, an exhaust port of the recirculated gas to the intake passage is disposed near the combustion chamber, and a direction of the exhaust port is so set that the recirculated gas which is introduced into the combustion chamber flows along an inner peripheral wall of a cylinder. The recirculated gas which is swirled along the inner peripheral wall of the cylinder inside the combustion chamber forms an annular layer of the recirculated gas in a region near the inner peripheral wall. As the results, in a center part of the combustion chamber where an ignition plug is disposed, concentration of the exhaust gas is relatively lowered thereby to enhance ignition performance, while in an outer peripheral part of the combustion chamber, the concentration of the exhaust gas near the inner peripheral wall of the cylinder is enhanced thereby to restrain a phenomenon of self ignition of an end gas, that is, so-called knocking.

Moreover, in JP-A-2010-84619, there is disclosed a technique for predicting a self ignition phenomenon which is called as low speed pre-ignition. A cause for occurrence of ordinary pre-ignition is, for example, a deposit which is accumulated inside the combustion chamber. After this deposit is peeled off from a wall face of the cylinder, the deposit is exposed to burning, and red heated, resulting in a source of the self ignition. On the other hand, a cause for occurrence of the low speed pre-ignition besides the above described deposit is considered to be drops of lubricating oil which are splashed, for example, from the inner peripheral wall of the cylinder. The drops of the lubricating oil are fired with a rise of the temperature inside the combustion chamber, and become a fire source for the self ignition of a gas mixture.

As measures for preventing the ordinary pre-ignition, there is a method of delaying an ignition time. On the other hand, as measures for preventing the low speed pre-ignition, there is a method of lowering temperature of an intake air, and a method of lowering concentration of oxygen in the gas mixture, for example. However, in case where the method of lowering the temperature of the intake air is adopted, remarkable reduction of output power is incurred, depending on condition of operation, in some cases. Moreover, in case where an amount of the recirculated gas which is introduced into the intake air is increased for the purpose of lowering the concentration of oxygen in the gas mixture, for example, in Patent Document 1, the pre-ignition is induced to the contrary, in some cases. For this reason, there is a limit in increasing the amount of the recirculated gas.

SUMMARY

In view of the above, it is an object of the present invention to more reliably prevent occurrence of low speed pre-ignition inside a combustion chamber.

In order to solve the above described problem, according to the invention, there is provided a control device of an engine, the engine including: a piston which is contained in a cylinder; an intake passage which is communicated to a combustion chamber of the cylinder; an exhaust passage which is led from the combustion chamber; a fuel injection valve which is configured to inject fuel to the combustion chamber or the intake passage; and an ignition unit which is provided in the combustion chamber, the control device comprising: a low speed pre-ignition predicting unit which is configured to perform prediction of occurrence of low speed pre-ignition, based on operation condition of the engine; and a lubricating oil injection controlling unit which is configured to control a lubricating oil injecting device to inject lubricating oil to the piston or a member located around the piston, based on the prediction of the occurrence of the low speed pre-ignition performed by the low speed pre-ignition predicting unit.

BRIEF DESCRIPTION OF THE DRAWINGS

FIGS. 3A to 3C are map views which are used in the controls according to this invention.

DETAILED DESCRIPTION OF EXEMPLARY EMBODIMENTS

Figure 1:
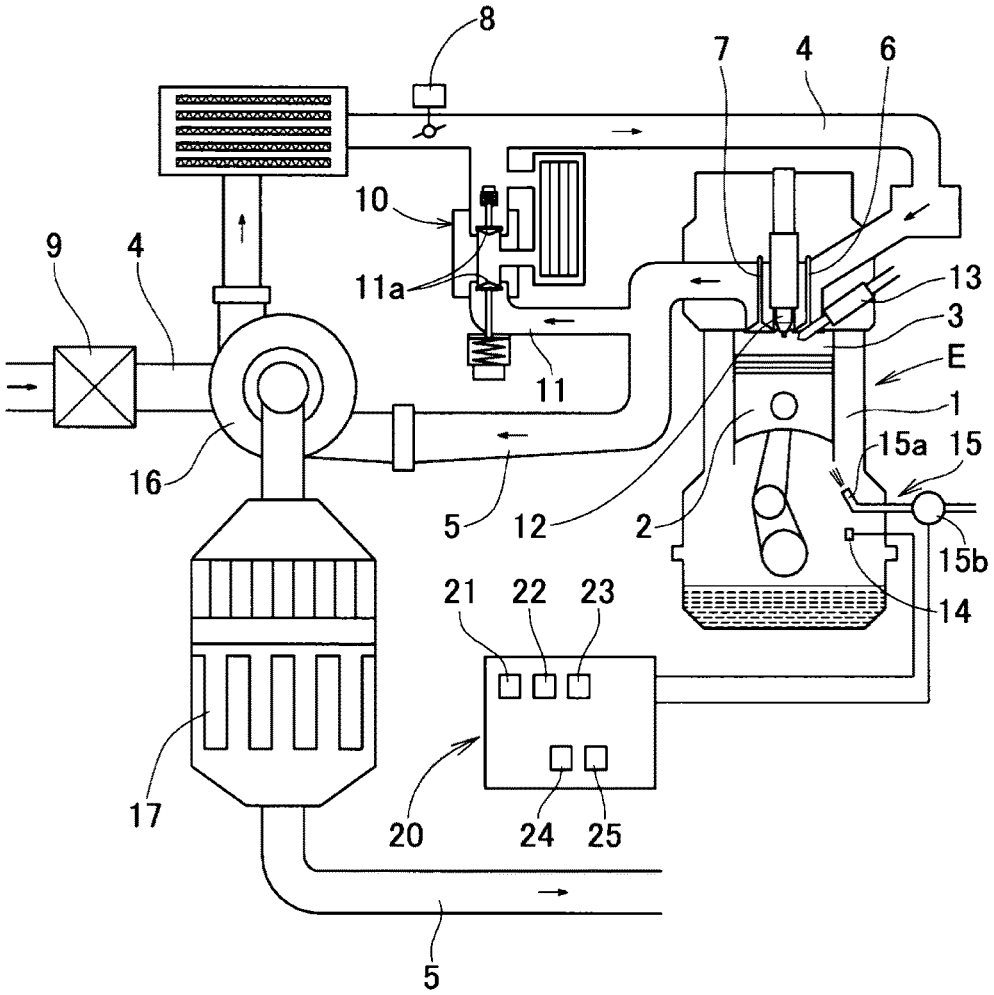
FIG. 1 is a schematic view of a control device of an engine in an embodiment according to this invention.

An embodiment according to this invention will be described referring to the drawings. FIG. 1 is a schematic view showing structure of an engine E and a control device of the engine E in this invention.

The engine E in this embodiment is a four-cycle gasoline engine provided with a supercharger, for an automobile. A piston 2 is contained in a cylinder 1 of the engine. A combustion chamber 3 is defined by an inner face of the cylinder 1 and an upper face of the piston 2 and so on.

The engine E is provided with an intake passage 4 for feeding an intake air into the combustion chamber 3 which contains the piston 2, an exhaust passage 5 which is led from the combustion chamber 3, a fuel injection valve 13 for injecting fuel into the combustion chamber 3, and so on. Moreover, an ignition plug as an ignition unit 12 is provided in a downward direction along an axis of the cylinder from a cylinder head side.

In these drawings, those members and means which are directly related to the invention are mainly shown, and other members are omitted in the drawings. Moreover, although only one cylinder is shown in the drawings, the number of the cylinders in the engine E is not limited.

An intake valve port which is an opening between the intake passage 4 and the combustion chamber 3 is opened or closed by an intake valve 6. Moreover, an exhaust valve port which is an opening between the exhaust passage 5 and the combustion chamber 3 is opened or closed by an exhaust valve 7.

These intake valve 6, exhaust valve 7, ignition unit 12, fuel injection valve 13, and other equipments which are required for operating the engine are respectively controlled by a control unit which is provided in an electronic control unit 20, by way of cables.

Moreover, the exhaust passage 5 and the intake passage 4 are communicated to each other by a recirculated gas passage 11 which forms an exhaust gas recirculation device 10. The exhaust gas recirculation device 10 has a function of recirculating a part of the exhaust gas which is exhausted from the engine, as the recirculated gas, from the exhaust passage 5 upstream than a turbine of a turbo charger 16 to the intake passage 4 downstream than a compressor of the turbo charger 16. It is to be noted that the exhaust gas recirculation device 10 is not limited to the above described, but a part of the exhaust gas which is exhausted from the engine may be recirculated as the recirculated gas, from the exhaust passage 5 downstream than the turbine of the turbo charger 16 to the intake passage 4 upstream than the compressor of the turbo charger 16.

The recirculated gas passage 11 is provided with a recirculated gas controlling unit 11*a* capable of adjusting an amount of the gas which flows by opening or closing the passage.

According to condition of a pressure inside the intake passage 4 which is controlled by the recirculated gas controlling unit 11*a* and a throttle valve 8 provided in the intake passage 4, and so on, a part of the exhaust gas which is exhausted from the engine E is recirculated to the intake passage 4 through the recirculated gas passage 11, as the recirculated gas, only by a required amount. These controls are also carried out by the electronic control unit 20 according to the operation condition.

Inside the cylinder, the fuel injection valve 13 is so arranged that the fuel injected from the fuel injection valve 13 is directed to a top face of the piston 2, while the piston 2 contained in the combustion chamber 3 is positioned close to an upper dead center, and directed to a wall face of the combustion chamber 3, while the piston 2 is positioned close to a lower dead center.

It is considered that as one of causes for occurrence of the pre-ignition, drops of the lubricating oil or so which are splashed from the cylindrical wall face of the cylinder 1 are fired with a rise of the temperature inside the combustion chamber 3, and this becomes a fire source for self ignition of the gas mixture. In view of the above, in the present invention, it is intended to predict occurrence of the low speed pre-ignition according to circumstances inside the combustion chamber 3, and to carry out controls for avoiding such phenomenon. Further, in this invention, at a time of predicting occurrence of this low speed pre-ignition, a manner where the fuel is adhered to the wall face of the combustion chamber 3, ratio of the recirculated gas in the intake air and so on are taken into consideration, so that more accurate prediction can be realized.

The electronic control unit 20 is provided with a low speed pre-ignition predicting unit 23 for predicting occurrence of the low speed pre-ignition on the basis of running condition of the engine.

Moreover, the engine E is provided with a lubricating oil injecting device 15 for injecting the lubricating oil to the piston 2 or a member located around the piston 2. The lubricating oil injecting device 15 includes an injection nozzle 15*a* for the lubricating oil which is provided in a crank case below the piston 2 so as to be directed to a lower face of the piston 2, and a control valve 15*b* for opening or closing a feeding passage of the lubricating oil to the injection nozzle 15*a*. The lubricating oil which is injected from the injection nozzle 15*a* is blown to the lower face of the piston 2, that is, the face of the piston 2 at an opposite side to the combustion chamber 3, a connecting rod which is connected thereto, an inner wall of the cylinder, and so on. The injection nozzle 15*a* is so constructed that an injecting direction of the lubricating oil can be changed by an actuating device such as a motor, and an injecting angle can be also increased or decreased. Therefore, it is possible to selectively inject the lubricating oil to an outer peripheral part, a center part or an entire surface of the lower face of the piston 2.

The electronic control unit 20 is provided with a lubricating oil injection controlling unit 25 which commands the lubricating oil injecting device 15 to inject the lubricating oil, on the basis of the prediction of occurrence of the low speed pre-ignition which is made by the low speed pre-ignition predicting unit 23. The lubricating oil injection controlling unit 25 controls opening or closing of the control valve 15*b*.

Now, a method of predicting occurrence of the low speed pre-ignition and a method of controlling the injection of the lubricating oil, in case where the occurrence of the low speed pre-ignition is predicted will be described.

The electronic control unit 20 is provided with a self ignition index calculating unit 21 for calculating a self ignition index K0 which indicates possibility of occurrence of the self ignition of the fuel at a crank angle before an ignition time during a compression stroke, on the basis of the temperature and pressure inside the combustion chamber 3.

The self ignition index calculating unit 21 calculates the self ignition index K0, using a predicting equation based on Livengood-Wu integral equation, $$K0 = \int_{IC}^{CA} \left(\frac{1}{\tau}\right) dt$$

$$\tau = AP^{-n} \exp(B/T)$$

wherein IC is an intake valve closing time, CA is a crank angle before the ignition time which is set, A, B, n are parameters concerning the fuel, P is pressure at the respective crank angles, and T is temperature at the respective crank angles. The crank angle CA before the ignition time, which is an end time of an integral range in the predicting equation, is considered to be set at an end time of the range in which there is possibility of occurrence of the low speed pre-ignition, that is, at the crank angle just before the ignition time.

In this case, the self ignition index calculating unit 21 may use other predicting equations in which at least the temperature and the pressure inside the combustion chamber 3 are taken as calculating elements.

The electronic control unit 20 is provided with a first correction coefficient calculating unit 22 for calculating a wall face adhered fuel correction coefficient C1 for correcting the self ignition index, on the basis of an amount of the fuel which is adhered to the wall face inside the combustion chamber 3 at the crank angle before the ignition time during the compression stroke.

On the basis of a first corrected self ignition index K1 which is calculated by the above described self ignition index K0 and the wall face adhered fuel correction coefficient C1, whether or not the low speed pre-ignition occurs is predicted. This prediction is carried out by the low speed pre-ignition predicting unit 23.

Specifically, the first corrected self ignition index K1 is as follows;

$$K1 = K0 \times C1 = \int_{IC}^{CA} \left(\frac{1}{\tau}\right) dt \times C1$$

In case where the first corrected self ignition index K1 is equal to or higher than a predetermined value, it is predicted that the low speed pre-ignition occurs up to a predetermined ignition time during the compression stroke (that is, up to the crank angle CA before the ignition time which is set by the predicting equation. Hereinafter, the same is applied). In case where the first corrected self ignition index K1 is lower than the predetermined value, it is predicted that the low speed pre-ignition will not occur before the ignition time during the compression stroke. It is to be noted that the prediction of the low speed pre-ignition based on the first corrected self ignition index K1 may be omitted, in case where occurrence of the low speed pre-ignition is predicted on the basis of a second corrected self ignition index K2, which will be described below.

Generally, when the amount of the adhered fuel is increased, an occurring rate of the low speed pre-ignition tends to be enhanced, even in case where occurrence of the pre-ignition is not predicted at the value of the self ignition index K0. For this reason, concept of the wall face adhered fuel correction coefficient C1 for correcting the self ignition index K0 is adopted in this invention.

Herein, P (the pressure at the respective crank angles) and T (the temperature at the respective crank angles) can be calculated by a condition equation, on the basis of the amount of the intake air into the combustion chamber 3, and IC (temperature and pressure inside the cylinder at a closing time of the intake valve), for example.

The amount of the adhered fuel which is a base for calculating the wall face adhered fuel correction coefficient C1 can be estimated from a fuel injection time (indicated by a crank angle before the upper dead center of the compression) on an X-axis, and temperature of a cooling medium of the engine (temperature of cooling water of the engine) on a Y-axis, as shown in a map view in FIG. 3A. The proper wall face adhered fuel correction coefficient C1 is set with respect to every amount of the adhered fuel a to n which has been estimated. Although this map view in FIG. 3A is made with respect to a specified intake temperature, map views with respect to other intake temperatures are separately set. An interval between the intake temperatures for setting the map view can be freely selected, for example, at every 1° C., at every 5° C., and so on.

Alternatively, in case where the amount of the adhered fuel at the specified crank angle has been already predicted, as shown in a map view in FIG. 3B, it is also possible to set the wall face adhered fuel correction coefficient C1 for correcting the self ignition index K0, on the basis of the amount of the adhered fuel a to k. It is to be noted that the wall face adhered fuel correction coefficient C1 takes a value 1 in case where there is no adhesion of the fuel, and therefore, takes a value larger than 1 in case where there is adhesion of the fuel.

In case where it is desired to perform more accurate prediction of occurrence of the low speed pre-ignition, an intake oxygen concentration correction coefficient C2 is adopted.

In case of a control device adopting the intake oxygen concentration correction coefficient C2, the electronic control unit 20 is provided with a second correction coefficient calculating unit 24 for calculating the intake oxygen concentration correction coefficient C2 for correcting the first corrected self ignition index K1, on the basis of a ratio of the recirculated gas in the intake air into the combustion chamber 3.

The intake oxygen concentration correction coefficient C2 can be calculated to be a to z, for example, as shown in a map view in FIG. 3C, on the basis of ratio of the recirculated gas in the intake air into the combustion chamber 3. It is to be noted that the intake oxygen concentration correction coefficient C2 takes a value 1, in case where the recirculated gas is not contained in the intake air, and takes a value smaller than 1 and larger than 0, because the value becomes smaller as a larger amount of the recirculated gas is contained in the intake air.

Then, on the basis of a second corrected self ignition index K2 which is calculated by the first corrected self ignition index K1 and the intake oxygen concentration correction coefficient C2, whether or not the low speed pre-ignition occurs is predicted. This prediction is carried out by the low speed pre-ignition predicting unit 23 which is provided in the electronic control unit 20, in the same manner. The self-ignition index described in the claims, that is, the index which is calculated by the self ignition index, the wall face adhered fuel correction coefficient, and the intake oxygen concentration correction coefficient corresponds to this second corrected self ignition index K2.

Specifically, the second corrected self ignition index K2 is as follows;

$$K2 = K1 \times C2 = \int_{IC}^{CA} \left(\frac{1}{\tau}\right) dt \times C1 \times C2$$

In case where the second corrected self ignition index K2 is larger than the predetermined value, it is predicted that the low speed pre-ignition will occur, before the predetermined ignition time during the compression stroke. In case where the second corrected self ignition index K2 is smaller than the predetermined value, it is predicted that the low speed pre-ignition will not occur, before the predetermined ignition time during the compression stroke.

Generally, there is such a tendency that when ratio of the recirculated gas increases and the oxygen concentration in the intake air decreases, the gas mixture is not ignited, and occurring rate of the low speed pre-ignition is lowered. This is the reason for adopting the concept of the intake oxygen concentration correction coefficient C2 which corrects the first corrected self ignition index K1, on the basis of the ratio of the recirculated gas in the intake air introduced into the combustion chamber 3.

In this case, the above described predetermined value for the first corrected self ignition index K1 and the predetermined value for the second corrected self ignition index K2 may be the same value. However, these predetermined values may be different from each other.

Further, on the basis of a third corrected self ignition index K3 which is calculated by the self ignition index K0 and the intake oxygen concentration correction coefficient C2, whether or not the low speed pre-ignition occurs is predicted. This prediction is carried out by the low speed pre-ignition predicting unit 23 which is provided in the electronic control unit 20, in the same manner.

The third corrected self ignition index K3 is calculated by the self ignition index K0 and the intake oxygen concentration correction coefficient C2, and shown as follows;

$$K3 = K0 \times C2 = \int_{IC}^{CA}\left(\frac{1}{\tau}\right)dt \times C2$$

Herein, in case where the predetermined value for the first corrected self ignition index K1 and the predetermined value for the second corrected self ignition index K2 are the same value, the predetermined value for the third corrected self ignition index K3 may be the same value as those predetermined values or may be a different value from them. In case where those predetermined values are different from each other, the third corrected self ignition index K3 may be the same value as either of those predetermined values, or may be a different value from any of those predetermined values.

Moreover, in this control device of the engine, in case where occurrence of the low speed pre-ignition is predicted, on the basis of estimation by the first corrected self ignition index K1, the second corrected self ignition index K2, and the third corrected self ignition index K3, a control for injecting a lubricating oil to the piston 2 and the member located around the piston in the cylinder is conducted, for the purpose of avoiding occurrence of the low speed pre-ignition. The temperature inside the combustion chamber 3 is lowered with the injection of the lubricating oil, and accordingly, occurrence of the low speed pre-ignition is depressed. This control for injecting the lubricating oil is carried out by the lubricating oil injection controlling unit 25.

Figure 2A:
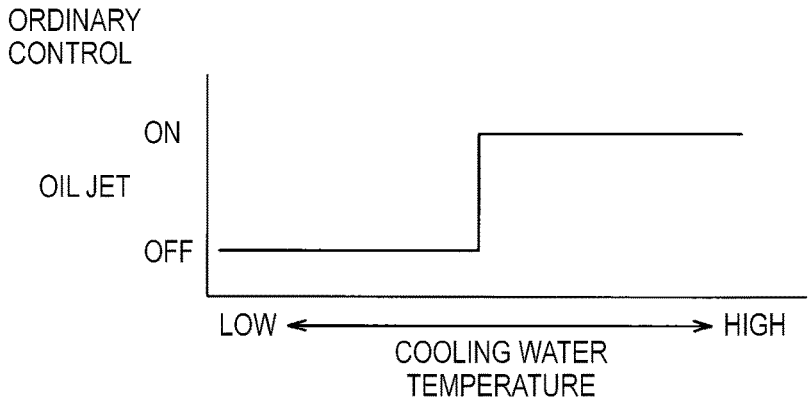
FIGS. 2A to 2C are graphs which are used in controls according to this invention.
Figure 2B:
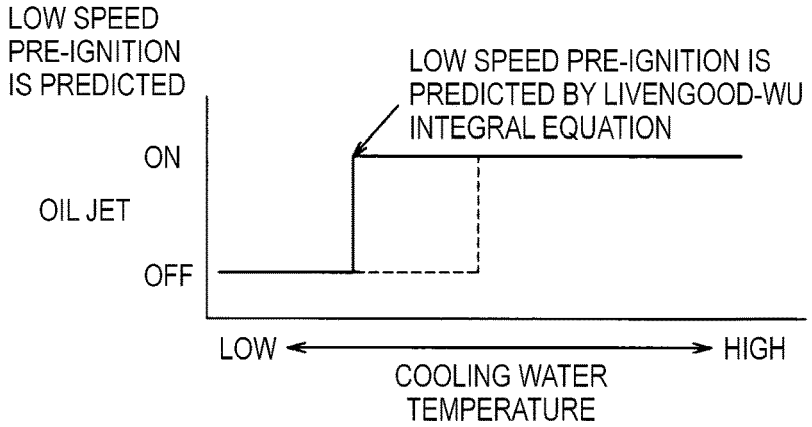
Figure 2C:
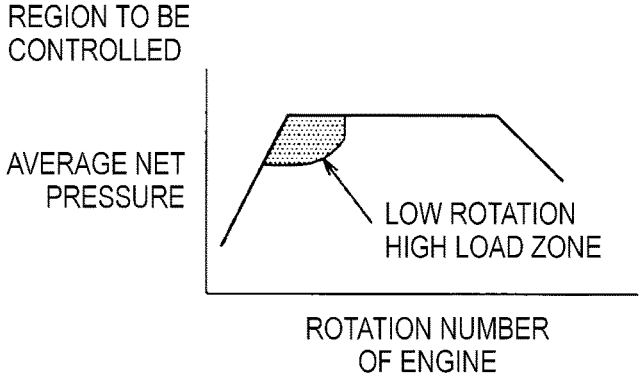

For example, FIG. 2A is a graph showing the control for injecting the lubricating oil for the purpose of restraining knocking or the ordinary pre-ignition, based on temperature of the cooling water of the engine E. When the temperature of the cooling water becomes higher than a predetermined temperature, injection of the lubricating oil for cooling an inside of the cylinder 1 is started. FIG. 2B shows that although the temperature of the cooling water does not reach the predetermined temperature, the injection of the lubricating oil is started, because occurrence of the low speed pre-ignition is predicted. Injecting direction of the lubricating oil can be optionally selected. However, because it is considered that the knocking or the ordinary pre-ignition is strongly affected by high temperature of an entire inside of the combustion chamber 3, the lubricating oil may be mainly injected from the injection nozzle 15*a* to a center part of the lower face of the piston 2 or an entirety of the lower face of the piston 2, in case of the injection control of the lubricating oil based on the temperature of the cooling water of the engine E, as shown in FIG. 2A. Moreover, because it is considered that the low speed pre-ignition is caused by firing of the lubricating oil which is splashed from the inner peripheral wall of the combustion chamber 3, the lubricating oil may be mainly injected from the injection nozzle 15*a* to an outer peripheral part of the lower face of the piston 2. In this manner, the injecting direction of the lubricating oil on the basis of the indexes such as the first corrected self ignition index K1, the second corrected self ignition index K2, and the third corrected self ignition index K3, may be different from the injecting direction of the lubricating oil on occasion of injecting on the basis of other control indexes such as the temperature of the cooling water. It is to be noted that occurrence of the low speed pre-ignition can be possibly predicted in a low rotation high load zone, as shown in FIG. 2C. In this low rotation high load zone, even under such operation condition that the lubricating oil is not injected under the ordinary control, the lubricating oil is injected, because occurrence of the low speed pre-ignition is predicted.

Concerning the above described respective indexes, the controls for injecting the lubricating oil will be described by way of some examples.

(Example 1 of the Control)

A case where the self ignition index K0 and the third corrected self ignition index K3 are not larger than the relevant predetermined values, whereas the first corrected self ignition index K1 and the second corrected self ignition index K2 are larger than the relevant predetermined values is presumed. This is the case where the respective indexes become larger than the predetermined values, by taking the wall face adhered fuel correction coefficient C1 into consideration. Therefore, it is considered that there is less emergency of occurrence of the low speed pre-ignition in this case, and so, the injecting amount of the lubricating oil is set to be relatively smaller, as compared with other cases of the injection control.

(Example 2 of the Control)

Then, a case where the third corrected self ignition index K3 is larger than the relevant predetermined value is presumed. The wall face adhered fuel correction coefficient C1 takes a value larger than 1, whereas the intake oxygen concentration correction coefficient C2 takes a value smaller than 1 and larger than 0. Therefore, in case where the third corrected self ignition index K3 is larger than the relevant predetermined value, it is considered that estimation by the first corrected self ignition index K1 and estimation by the second corrected self ignition index K2 are also larger than the relevant predetermined values, in case where the predetermined values for the indexes K1, K2, K3 are set to be the same value. Alternatively, it is considered that even though the predetermined values are set to be different from each other, the respective indexes K1, K2 are larger than the relevant predetermined values, in many cases. For this reason, it is necessary to carry out control for avoiding the low speed pre-ignition in an early period. Therefore, in this example, the amount of the lubricating oil is set to be relatively larger than the above described injection control in Example 1.

(Example 3 of the Control)

On the basis of the values of the first corrected self ignition index K1, the second corrected self ignition index K2, and the third corrected self ignition index K3 as described above, it is possible to carry out the control for increasing or decreasing the amount of the lubricating oil which is injected by the lubricating oil injecting device 15.

For example, the first corrected self ignition index K1 will be described, as an example. Estimated values for the first corrected self ignition index K1 are determined by a plurality of steps. These values are named as a first estimated value t1, a second estimated value t2, and a third estimated value t3 in order from the smallest value. In case where the value of the first corrected self ignition index K1 exceeds the predetermined value which is a standard for predicting occurrence of the low speed pre-ignition, it is so set that the amount of the lubricating oil to be injected may be different, depending on whether or not the value of the index K1 is larger than the predetermined value and smaller than the first estimated value t1, whether or not the value is larger than the first estimated value t1 and smaller than the second estimated value t2, whether or not the value is larger than the second estimated value t2 and smaller than the third estimated value t3, and whether or not the value is larger than the third estimated value t3. Because there is a larger possibility of occurrence of the low speed pre-ignition, as the value of the first corrected self ignition index K1 grows larger, the amount of the lubricating oil to be injected is also increased.

In this manner, the amount of the lubricating oil which is injected by the lubricating oil injecting device 15 may be increased stepwise, as the value of the index grows larger, on the basis of either of the first corrected self ignition index K1, the second corrected self ignition index K2, and the third corrected self ignition index K3. Alternatively, it may be so constructed that the value of either of the indexes K1, K2, K3 and the amount of the lubricating oil are matched with each other in ratio of 1 to 1, using the map or the like, and then, the amount of the lubricating oil is increased, as the value of the index K1, K2, K3 grows larger.

Although in the above described embodiment, a cylinder inside injection valve (a direct injection valve) for directly injecting the fuel into the combustion chamber 3 is adopted as the fuel injection valve 13, it is also possible to substitute this valve with a port injection valve for injecting the fuel into the intake passage 4. Alternatively, the cylinder inside injection valve and the port injection valve may be combined for use, as the fuel injection valve 13.

The above described prediction of occurrence of the low speed pre-ignition and succeeding controls for injection of the lubricating oil for the purpose of avoiding the low speed pre-ignition are effective within a range where the rotation number of the engine is generally less than 3000 rotations.

In this embodiment, the structure of the invention has been described referring to the four-cycle gasoline engine for an automobile. However, it is also possible to apply this invention to an engine of another type in which there is possibility of occurrence of the pre-ignition.

According to this invention, the lubricating oil is injected to the piston or the member located around the piston, based on information concerning prediction of occurrence of the low speed pre-ignition. As the results, it is possible to more reliably prevent occurrence of the pre-ignition inside the combustion chamber.

What is claimed is:

1. A control device of an engine, the engine including: a piston which is contained in a cylinder; an intake passage which is communicated to a combustion chamber of the cylinder; an exhaust passage which is led from the combustion chamber; a fuel injection valve which is configured to inject fuel to the combustion chamber or the intake passage; and an ignition unit which is provided in the combustion chamber, the control device comprising:

a low speed pre-ignition predicting unit which is configured to perform prediction of occurrence of low speed pre-ignition, based on operation condition of the engine;

a lubricating oil injection controlling unit which is configured to control a lubricating oil injecting device to inject lubricating oil to the piston or a member located around the piston, based on the prediction of the occurrence of the low speed pre-ignition performed by the low speed pre-ignition predicting unit;

a self ignition index calculating unit which is configured to calculate self ignition index which indicates possibility of occurring self ignition of the fuel at a crank angle before an ignition time during a compression stroke, based on temperature and pressure inside the combustion chamber; and a first correction coefficient calculating unit which is configured to calculate a wall face adhered fuel correction coefficient for correcting the self ignition index, based on an amount of fuel that is adhered to a wall face inside the combustion chamber at the crank angle, wherein the low speed pre-ignition predicting unit is configured to perform the prediction of the occurrence of the low speed pre-ignition, based on the self ignition index calculated by the self ignition index calculating unit and the wall face adhered fuel correction coefficient.

2. The control device according to claim 1, wherein the lubricating oil injection controlling unit is configured to adjust an injecting amount of the lubricating oil, based on the self ignition index.

3. The control device according to claim 1, wherein an injecting direction of the lubricating oil based on the self ignition index is different from an injecting direction of lubricating oil based on other control index.

4. The control device according to claim 1, wherein the amount of the fuel adhered to the wall face is conjectured from an injecting time of the fuel and temperature of a cooling medium of the engine or temperature of an intake air.

5. The control device according to claim 1, wherein the lubricating oil injection controlling unit is configured to adjust an injecting amount of the lubricating oil, based on the index.

6. The control device according to claim 5, wherein an injecting direction of the lubricating oil based on the index is different from an injecting direction of lubricating oil based on other control index.

7. The control device according to claim 1, wherein the engine further includes an exhaust gas recirculation device which is configured to introduce a part of exhaust gas in the exhaust passage into an intake air as recirculated gas, the control device is further comprises a second correction coefficient calculating unit which is configured to calculate an intake oxygen concentration correction coefficient for correcting the self ignition index, based on a ratio of the recirculated gas in the intake air into the combustion chamber, and the low speed pre-ignition predicting unit is configured to perform the prediction of the occurrence of the low speed pre-ignition, based on an index the is calculated by the self ignition index, the wall face adhered fuel correction coefficient, and the intake oxygen concentration correction coefficient.

8. The control device according to claim 7, wherein the lubricating oil injection controlling unit is configured to adjust an injecting amount of the lubricating oil, based on the index.

9. The control device according to claim 7, wherein an injecting direction of the lubricating oil based on the index is different from an injecting direction of lubricating oil based on other control index.

* * * * *